US005676874A

United States Patent [19]

Lee

[11] Patent Number: 5,676,874

[45] Date of Patent: Oct. 14, 1997

[54] FLOOR FORM ASSEMBLY AND APPARATUS USED THEREWITH

[76] Inventor: Wen-Yuan Lee, 7F-3, No. 8, Lane 390, Sec. 1, Chien-Kang Rd., Tainan City, Taiwan

[21] Appl. No.: 512,645

[22] Filed: Aug. 8, 1995

[51] Int. Cl.[6] ..... E04G 11/52

[52] U.S. Cl. ..... 249/19; 249/23; 249/25; 249/28; 249/192; 249/196; 249/210; 249/211

[58] Field of Search ..... 249/18, 19, 23, 249/25, 28, 192, 196, 210, 211

[56] References Cited

U.S. PATENT DOCUMENTS

| | | | |
|---|---|---|---|
| 949,093 | 2/1910 | Sherwood | 249/23 |
| 1,942,093 | 1/1934 | Goldsmith et al. | 249/210 |
| 2,974,386 | 3/1961 | Frost | 249/211 |
| 3,130,470 | 4/1964 | Bowden et al. | 249/192 |
| 3,784,151 | 1/1974 | Steele | 249/28 |
| 3,827,665 | 8/1974 | Kistler | 249/18 |
| 4,077,598 | 3/1978 | Marseillan | 249/18 |
| 4,342,440 | 8/1982 | Eyden | 249/23 |
| 4,768,938 | 9/1988 | Greeson | 249/19 |
| 4,901,497 | 2/1990 | Lee | 249/196 |

*Primary Examiner*—Thomas R. Weber
*Attorney, Agent, or Firm*—Birch, Stewart, Kolasch & Birch, LLP

[57] ABSTRACT

A floor form assembly is adapted for use in the construction of a concrete floor of a structure that is enclosed by surrounding walls, and includes a plurality of mounting devices adapted to be mounted on the surrounding walls at a top portion of the structure, a plurality of elongated girders connected removably and longitudinally to one another so as to be adapted to extend along a lengthwise direction of the top portion of the structure, a plurality of supporting ribs connected removably to the girders such that the supporting ribs extend transversely from opposite longitudinal sides of the girders and are disposed spacedly on the girders so as to be adapted to extend along a transverse direction of the top portion of the structure, a plurality of vertical form units, each being connected removably to distal end portion of one of the girders and the supporting ribs, the vertical form units being adapted to form an enclosing frame that is supported removably on the mounting devices and that is adapted to be disposed at the top portion of the structure, and a plurality of horizontal form units arranged on the supporting ribs and connected removably to one another so as to form a supporting surface for concrete.

22 Claims, 18 Drawing Sheets

FLOOR FORM ASSEMBLY AND APPARATUS USED THEREWITH

BACKGROUND OF THE INVENTION

1. Field of the Invention

The invention relates to a floor form assembly, more particularly to a modular floor form assembly which is adapted for use in the construction of a concrete floor of a structure that is enclosed by surrounding walls, and to various apparatus to be used with the floor form assembly to facilitate dismantling of the latter when the concrete floor is formed.

2. Description of the Related Art

Usually, when constructing concrete structures such as houses and the like, a large amount of time and manpower is wasted on the nailing of wooden panels to assemble mold forms prior to pouring of the concrete and on the dismantling of the mold forms when the concrete hardens. The use of wooden panels as mold forms has become obsolete in the construction of concrete buildings since recent developments in the field of construction have resulted in the development of reusable or modular steel forms which permit fast and efficient construction of concrete structures at a lower manpower requirement.

The applicant has disclosed in co-pending U.S. patent application Ser. No. 08/386,830, filed on Feb. 10, 1995, now abandoned a method for constructing a concrete floor of an upper storey of a structure, the structure having a lower storey enclosed by surrounding walls that are formed with window openings and that confine an internal space with an open top. In this method, a floor form assembly is hoisted into the lower storey of the structure through the open top. The floor form assembly is then secured to a ground surface of the lower storey, and concrete is poured on top of the floor form assembly to form the concrete floor of the upper storey of the structure. Since the surrounding walls are formed only with window (or door) openings, the floor form assembly is dismantled into small pieces which can be passed manually through the various openings in the surrounding walls so as to be assembled anew once the concrete has hardened. Thus, there is always a need to improve the construction of the floor form assembly and the apparatus used therewith to facilitate installation and removal of the floor form assembly so as to achieve faster and more efficient construction at a lower manpower requirement.

SUMMARY OF THE INVENTION

Therefore, the main object of the present invention is to provide a modular floor form assembly which is easy to install and dismantle and which is adapted for use in the construction of a concrete floor of a structure that is enclosed by surrounding walls.

Another object of the present invention is to provide a supporting apparatus which is adapted to support a floor form assembly thereon so as to permit slight vertical movement of the floor form assembly to facilitate removal of the floor form assembly after a concrete floor has been constructed.

Still another object of the present invention is to provide a fastening apparatus which facilitates connection and disconnection of two form units of a floor form assembly.

A further object of the present invention is to provide a form contracting apparatus which is adapted for use in a floor form assembly having adjacent form units so as to form a clearance between flat surfaces of the adjacent form units to facilitate removal of the floor form assembly after a concrete floor has been constructed.

According to one aspect of the present invention, a floor form assembly is adapted for use in the construction of a concrete floor of a structure that is enclosed by surrounding walls, and comprises: a plurality of mounting devices adapted to be mounted on the surrounding walls at a top portion of the structure; a plurality of elongated girders connected removably and longitudinally to one another so as to be adapted to extend along a lengthwise direction of the top portion of the structure; a plurality of supporting ribs connected removably to the girders such that the supporting ribs extend transversely from opposite longitudinal sides of the girders and are disposed spacedly on the girders so as to be adapted to extend along a transverse direction of the top portion of the structure; a plurality of vertical form units, each being connected removably to distal end portion of one of the girders and the supporting ribs, the vertical form units being adapted to form an enclosing frame that is supported removably on the mounting devices and that is adapted to be disposed at the top portion of the structure; and a plurality of horizontal form units arranged on the supporting ribs and connected removably to one another so as to form a supporting surface for concrete.

After the girders, the supporting ribs, the vertical form units and the horizontal form units have been assembled, the assembly of the girders, the supporting ribs, the vertical form units and the horizontal form units is hoisted into the top portion of the structure to serve as a support for the concrete floor to be constructed.

According to another aspect of the present invention, a supporting apparatus is adapted to support a floor form assembly thereon so as to permit slight vertical movement of the floor form assembly. The supporting apparatus comprises a stationary mounting seat which has a horizontally extending support portion, and an operating lever which has a handle portion and a carrying portion that extends transversely from one end of the handle portion. The carrying portion has a generally rectangular cross-section with opposite longer sides and opposite shorter sides that adjoin the longer sides. The carrying portion is disposed between the support portion of the mounting seat and the floor form assembly so as to be adapted to support the floor form assembly on the mounting seat. Rotation of the operating lever so that a selected one of the longer and shorter sides of the carrying portion abuts the floor form assembly results in slight vertical movement of the floor form assembly.

According to still another aspect of the present invention, a fastening apparatus is adapted to interconnect removably adjacent form units of a floor form assembly, and comprises: two fastening seats adapted to be secured respectively on the adjacent form units such that the fastening seats are disposed on two sides of mating edges of the adjacent form units, each of the fastening seats being formed with a rectangular hole and a notch located on a longer side of the rectangular hole and extending to the rectangular hole, the notch being shorter than the rectangular hole; and a fastening lever having a handle portion and a fastening portion that extends transversely from one end of the handle portion, the fastening portion having a generally rectangular cross-section with rounded corners and corresponding in size with the rectangular holes of the fastening seats, the fastening portion being thinner than length of the notches of the fastening seats.

After the fastening portion of the fastening lever has been extended partially into the rectangular holes of the fastening seats via the notches of the fastening seats, the fastening lever can be rotated such that the fastening portion extends fully into the rectangular holes to interconnect removably the adjacent form units.

According to a further aspect of the present invention, a form contracting apparatus is adapted for use in a floor form assembly having adjacent form units so as to form a clearance between flat surfaces of the adjacent form units. The form contracting apparatus comprises: a pair of joining plates adapted to be secured respectively on the adjacent form units such that the joining plates extend from mating edges of the adjacent form units, the joining plates being in sliding contact with each other and being formed with a respective rectangular notch, the rectangular notches of the joining plates having equal widths and being partially aligned when the flat surfaces of the adjacent form units are flush with one another; and an operating lever having a handle portion and a fastening portion that extends transversely from one end of the handle portion, the fastening portion having a generally rectangular cross-section with opposite longer sides and opposite shorter sides that adjoin the longer sides, the shorter sides having a length sufficient to permit insertion of the fastening portion into the rectangular notches of the joining plates when the rectangular notches are partially aligned, the longer sides having a length equal to the width of the rectangular notches.

After the fastening portion of the operating lever has been extended into the rectangular notches of the joining plate seats such that one of the shorter sides of the fastening portion rests on bottom of the rectangular notches while the rectangular notches are partially aligned, the operating lever can be rotated such that one of the longer sides of the fastening portion rests on the bottom of the rectangular notches, thereby aligning fully the rectangular notches and causing the flat surfaces of the adjacent form units to form the clearance therebetween.

According to still another aspect of the present invention, a fastening apparatus is adapted to interconnect removably two form units of a floor form assembly, and comprises a first connecting plate adapted to be secured to one of the form units and formed with a hook portion, a second connecting plate adapted to be secured to the other one of the form units and formed with a hook portion that engages fittingly and removably the hook portion of the first connecting plate such that the hook portion of the first connecting plate is superimposed thereon, and a clamping lever having a handle portion and a jaw portion formed on one end of the handle portion. The jaw portion includes a hooking jaw and a curved supporting jaw. The hooking jaw and the supporting jaw confine a space therebetween. The hooking jaw has a distal end which forms a clearance with the supporting jaw. The clearance serves as an entry into the space and has a width equal to combined thickness of the hook portions of the first and second connecting plates.

After the hook portion of the first connecting plate is superimposed on the hook portion of the second connecting plate, distal ends of the hook portions can be inserted into the space confined by the jaws of the jaw portion of the clamping lever via the clearance. Rotation of the clamping lever thereafter causes the hooking jaw and the supporting jaw to clamp the hook portions therebetween to achieve tight connection between the first and second connecting plates and to interconnect securely and removably the form units.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of the present invention will become apparent in the following detailed description of the preferred embodiments, with reference to the accompanying drawings which are given by way of illustration only, and thus are not limitative of the present invention, and of which.

DETAILED DESCRIPTION OF THE PREFERRED EMBODIMENTS

Figure 1:
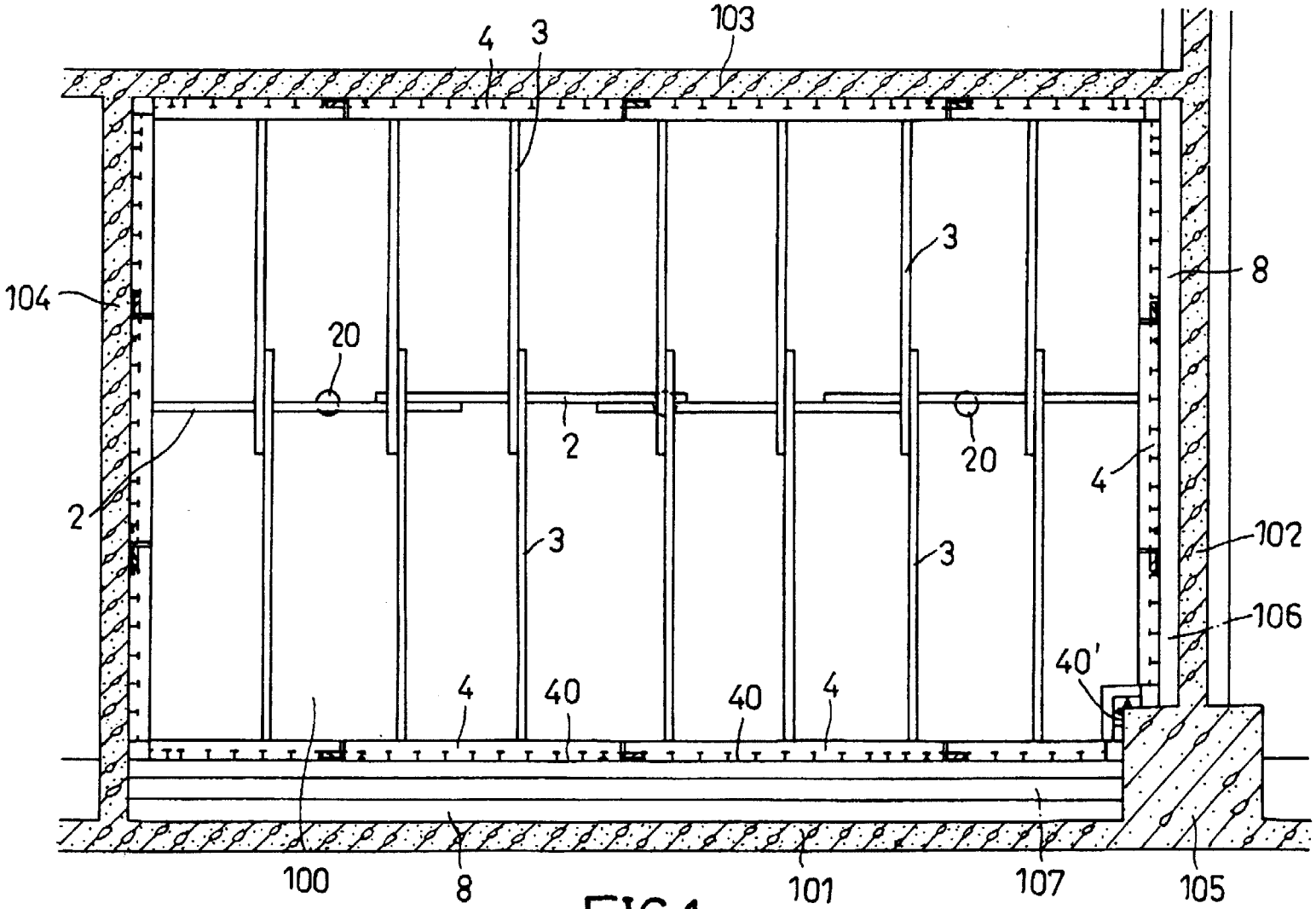
FIG. 1 is a top view which illustrates the girders and supporting ribs of the first preferred embodiment of a floor form assembly according to the present invention.

Referring to FIGS. 1 to 4, the first preferred embodiment of a floor form assembly according to the present invention is shown to be used in the construction of a concrete floor of an upper storey of a structure which has a lower storey with a ground surface 100 (or floor). The lower storey is enclosed by four surrounding walls 101, 102, 103, 104 that are formed with window and door openings and that confine a room with an open top. The surrounding walls 101, 102, 103, 104 may be provided with vertical pillars 105 and horizontal structural beams 106, 107.

The floor form assembly comprises girders 2, supporting ribs 3, vertical form units 4, horizontal form units 5, mounting devices 6, 7 secured to top portions of the surrounding walls 101, 102, 103, 104, and props 20 connected to bottom portions of the girders 2.

The girders 2 are elongated beams that are U-shaped in cross section. For a room that is 4 meters long, each of the girders 2 preferably has a length of 1.2 to 1.5 meters. Adjacent girders 2 are connected removably and longitudinally at their end portions by means of screw fasteners. The total length of interconnected girders 2 must be sufficient to enable the latter to extend fully along a lengthwise direction of the top portion of the room.

The supporting ribs 3 are elongated beams that are L-shaped in cross section. For a room that is 3 meters wide, each of the supporting ribs 3 preferably has a length of 1.6 to 2 meters. The supporting ribs 3 are connected removably to the girders 2. In this embodiment, the supporting ribs 3 are mounted removably on the girders 2 by means of C-type clamps 30. The supporting ribs 3 extend transversely from opposite longitudinal sides of the girders 2 and are disposed spacedly on the girders 2 such that the supporting ribs 3 extend fully along a transverse direction of the top portion of the room.

Each of the vertical form units 4 includes a plurality of elongated form plates 40 (see FIG. 6) that are equal in length and that are U-shaped in cross section. The form plates 40 are parallel to one another and are arranged side-by-side so that adjacent form plates 40 can be interconnected by means of screw fasteners (see FIG. 11–13). The form plates 40 may be selected to have different widths, ranging up to 20 cm, to obtain the desired width of the vertical form unit 4 that is required for the intended application. Some of the vertical form units 4 may include an angled form plate 40, which complements a corner portion of a vertical pillar 105, as shown in FIG. 1. The vertical form units 4 are interconnected to form an enclosing frame that is inserted into the room via the open top of the latter so as to be disposed beside top portions of the surrounding walls 101, 102, 103, 104.

Each of the horizontal form units 5 includes a plate body with a specified size and strength. The horizontal form units 5 are arranged side-by-side on top of the supporting ribs 3 and form a supporting surface for concrete. Some of the horizontal form units 5 are formed with rectangular holes at appropriate locations. Each of the rectangular holes is covered by a small cover plate 51. The bottom of each cover plate 51 is connected to a respective post 50.

The mounting devices 6, 7 are mounted spacedly and securely to top portions of the surrounding walls 101, 102, 103, 104 by means of bolts which engage sockets or holes formed in the surrounding walls 101, 102, 103, 104. Each of the mounting devices 6, 7 has a top portion with a horizontal support face for supporting one of the vertical form units 4 thereon. The mounting devices 6 further support a beam form unit 8 at locations where the horizontal structural beams 106, 107 are to be formed. The beam form unit 8 includes a plurality of elongated form plates that are arranged longitudinally and successively on the mounting devices 6. The beam form unit 8 has dimensions which correspond with those of the structural beam 106, 107 to be formed, and are disposed between bottom edges of the vertical form units 4 and one of the surrounding walls 101, 102, 103, 104 so as to form a concrete receiving space therewith.

Figure 2:
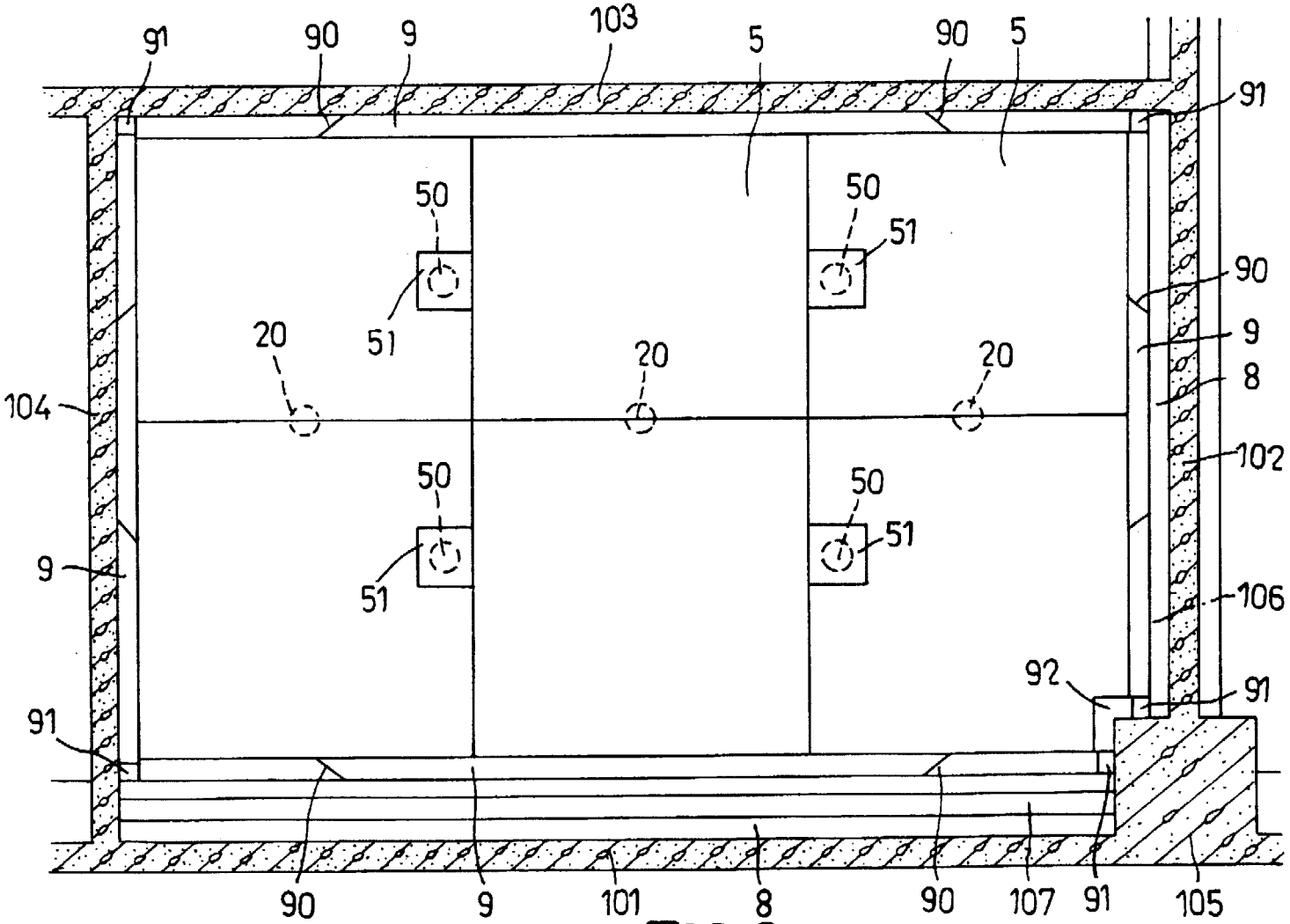
FIG. 2 is a top view which illustrates the horizontal form units and edge form unit of the first preferred embodiment.
Figure 5:
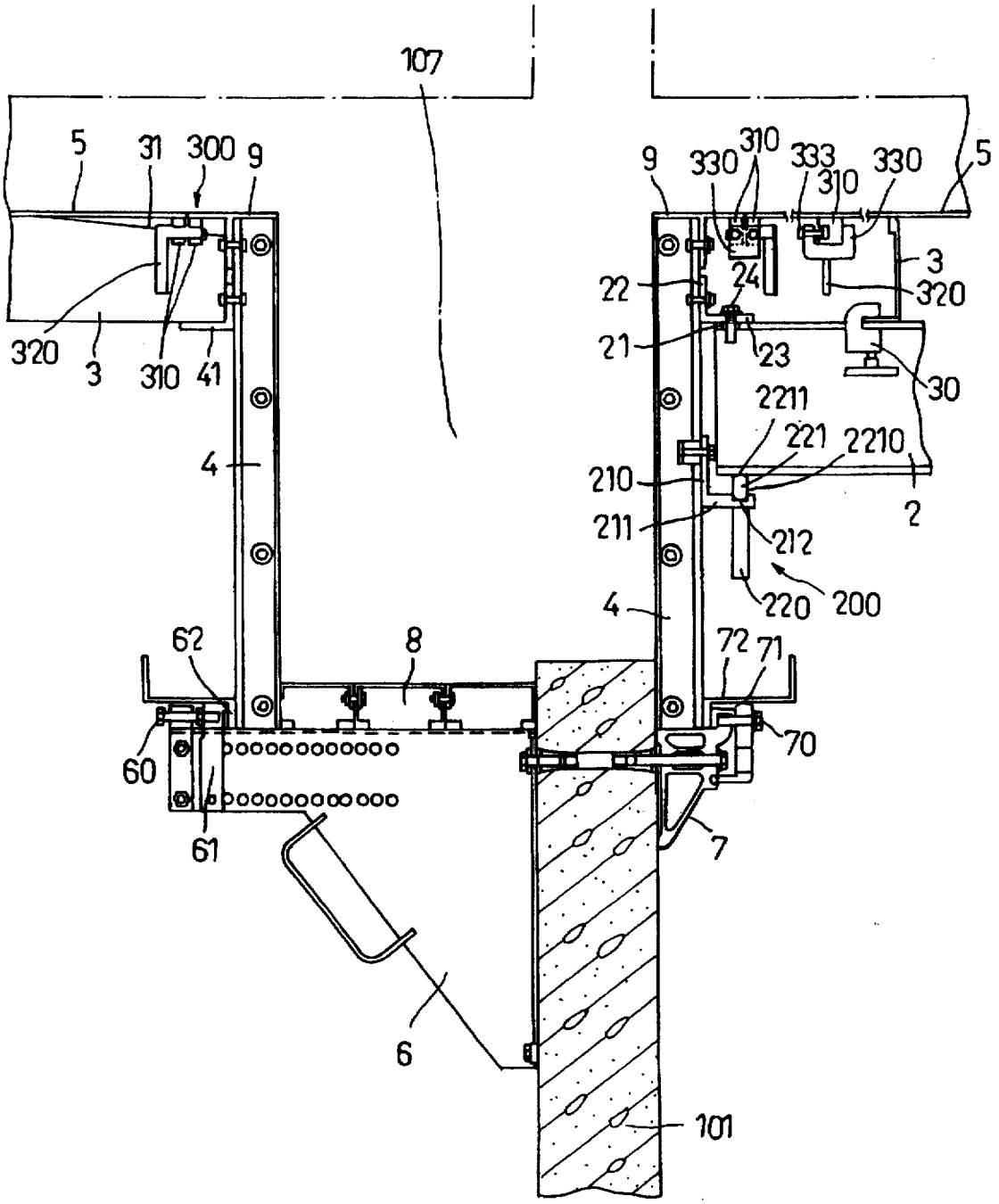
FIG. 5 is an enlarged view which illustrates the connection among the mounting devices, vertical form units, girders and supporting ribs of the first preferred embodiment.

Referring to FIG. 5, an edge form unit 9 is installed on top ends of the vertical form units 4. The edge form unit 9, which includes a plurality of elongated form plates that are T-shaped in cross section, has a flat top end that is flush with the horizontal form units 5 and that abuts tightly with the same. Adjacent form plates of the edge form unit 9 abut at their adjoining ends. As shown in FIG. 2, the form plates of the edge form unit 9 have inclined ends 90 to facilitate installation. At corners of the edge form unit 9, a small rectangular plate 91 and/or an L-shaped plate 92 may be installed. An assembled view of the floor form assembly of the first preferred embodiment can be found in FIG. 6.

As shown in FIG. 5, the mounting devices 6, 7 are mounted respectively on opposite sides of the top portion of the surrounding wall 101. Screw fasteners 60, 70 secure positioning units 61, 71 onto the mounting devices 6, 7. The positioning units 61, 71 urge horizontal pressing strips 62, 72 toward the surrounding wall 101 in order to abut tightly against the bottom edge of the vertical form units 4 so as to position properly the latter and cause the beam form unit 8 to abut tightly against the surrounding wall 101. A plurality of angled mounting pieces 41 are secured by means of screw fasteners on the top end of the vertical form units 4 so that the vertical form units 4 can support the distal end portion of the supporting ribs 3. Preferably, without affecting the load bearing capacity of the supporting ribs 3, the distal end portion of each of the supporting ribs 3 is formed with a downwardly inclining top edge 31 that forms a clearance to facilitate movement and slight rotation of the supporting ribs 3 during disassembly.

Two supporting apparatus 200 connect the vertical form units 4 to two ends of the interconnected girders 2. Each supporting apparatus 200 includes a stationary mounting seat 210 which is secured on one of the vertical form units 4 and which has a horizontal support portion 211 that extends parallel to the girders 2 and that is formed with a shallow positioning notch 212, and an L-shaped operating lever 220 with a handle portion and a carrying portion 221 that extends transversely from one end of the handle portion. The carrying portion 221 has a generally rectangular cross section with rounded corners, opposite longer sides 2210 and opposite shorter sides 2211 that adjoin the longer sides 2210. Preferably, the longer and shorter sides 2210, 2211 of the carrying portion 221 form a predetermined height difference, such as about 2 cm. The carrying portion 221 is to be disposed between the support portion 211 of the mounting seat 210 and the interconnected girders 2 so that, when the longer sides 2210 are disposed uprightly, one of the shorter sides 2211 of the carrying portion 221 can be received in the positioning notch 212 of the support portion 211, while the other one of the shorter sides 2211 supports one of the distal end portions of the interconnected girders 2 on the mounting seat 210. When the operating lever 220 is turned by a 90° angle such that the longer sides 2210 are disposed horizontally, one of the longer sides 2210 supports the interconnected girders 2 on the mounting seat 210, thereby causing slight downward movement of the latter. From the foregoing, it can be understood that the operating lever 220 is operated so that a selected one of the longer and shorter sides 2210, 2211 of the carrying portion 221 abuts the interconnected girders 2, thereby resulting in a slight vertical movement of the girders 2 to facilitate dismantling of the floor form assembly.

The distal end portions of the interconnected girders 2 are formed with a through hole 21 on a top end. The vertical form units 4 which are adjacent to the distal end portions of the interconnected girders 2 have a respective mounting piece 22 secured thereon. The mounting piece 22 has a lower end with a horizontal extension 23 that extends parallel to the girders 2. A locking pin 24 extends threadedly through the horizontal extension 23 and has a length sufficient so as to extend through the through hole 21 in one of the distal end portions of the interconnected girders 2 to prevent lateral movement of the latter. The locking pin 24, however, permits slight vertical movement of the girders 2 when the operating lever 220 of the supporting apparatus 200 is turned.

Figure 8:
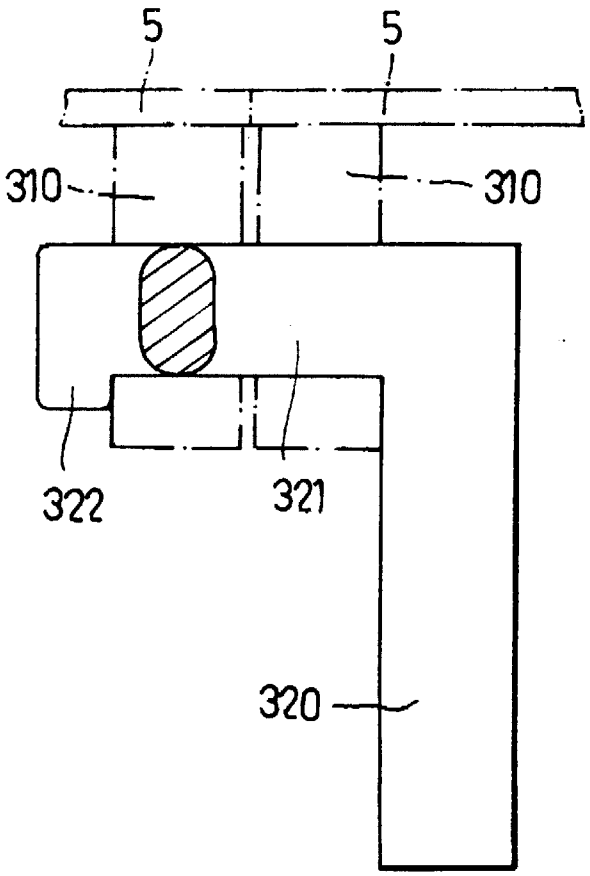
FIG. 8 is a side view which illustrates a fastening lever of the fastening apparatus of the present invention.
Figure 7:
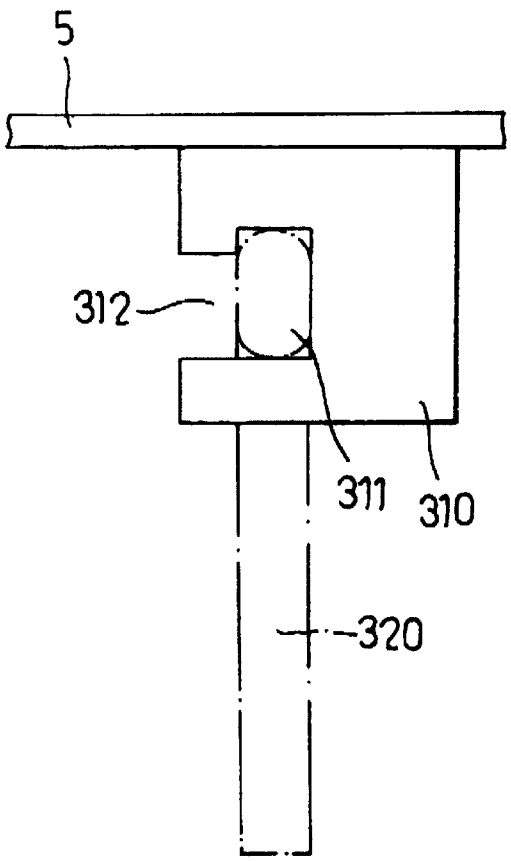
FIG. 7 is a side view which illustrates a fastening seat of a fastening apparatus of the present invention.

A plurality of fastening apparatus 300 are employed to interconnect removably adjacent ones of the horizontal form units 5, the cover plates 51 and the form plates of the edge form unit 9. Each fastening apparatus 300 includes two fastening seats 310 disposed respectively on two sides of the mating edges of an adjacent pair of the horizontal form units 5, the cover plates 51 and the form plates of the edge form unit 9. As shown in FIG. 7, each of the fastening seats 310 is formed as a rectangular block with a top side that is welded on the bottom face of a respective one of the horizontal form units 5, the cover plates 51 and the form plates of the edge form unit 9. The fastening seat 310 is formed with a rectangular hole 311 and a notch 312 located on a longer side of the rectangular hole 311 and extending to the rectangular hole 311 to serve as an entry into the latter. The notch 312 should be shorter than the rectangular hole 311. Each fastening apparatus 300 further includes an L-shaped fastening lever 320. As shown in FIG. 8, the fastening lever 320 has a handle portion and a fastening portion 321 that extends transversely from one end of the handle portion. The fastening portion 321 has a generally rectangular cross section with rounded corners and corresponds in size with the rectangular holes 311 in the fastening seats 310. The fastening portion 321, however, should be thinner than the length of the notches 312 to permit insertion or removal of the fastening portion 310 from the rectangular holes 311. The fastening portion 321 has a distal end section 322 which is opposite to the handle portion and which extends in a same direction of the handle portion. The distal end section 322 is displaced from the handle portion by a distance equal to the combined thickness of the fastening seats 310.

When the fastening apparatus 300 is used to connect removably two adjacent horizontal form units 5, the horizontal form units 5 are initially arranged side-by-side on the supporting ribs 3 such that the notches 312 of two fastening seats 310 disposed respectively on two sides of the mating edges of the horizontal form units 5 are fully aligned with one another. The fastening lever 320 is initially placed in a horizontal position. That is, the handle portion is disposed horizontally so that the longer sides of the fastening portion 321 are parallel to the horizontal form units 5 to permit partial extension of the fastening portion 321 into the rectangular holes 311 of the fastening seats 310 via the aligned notches 312. The fastening lever 320 is then turned by a 90° angle such that the fastening portion 321 extend fully into the rectangular holes 311 to connect the fastening seats 310. The fastening seats 310 are clamped between the distal end section 322 of the fastening portion 321 and the handle portion of the fastening lever 320 to prevent movement of the fastening seats 310 along the fastening portion 321 when the fastening portion 321 extends fully into the rectangular holes 311 of the fastening seats 310.

Figure 9:
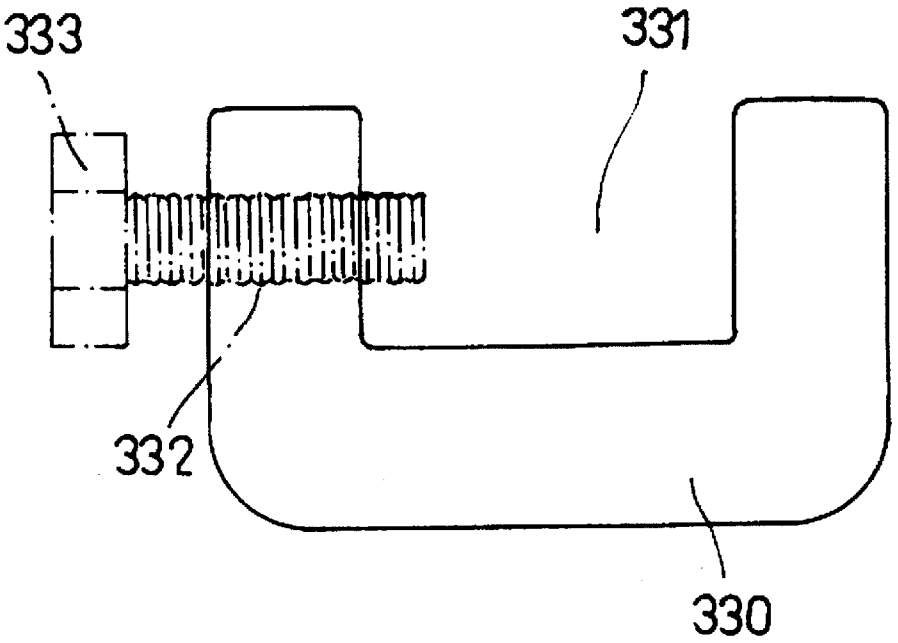
FIG. 9 is a side view which illustrates a clamping unit of the fastening apparatus of the present invention.

Each fastening apparatus 300 may further include a clamping unit 330, as shown in FIG. 5. Referring to FIG. 9, the clamping unit 330 includes a generally U-shaped clamping block that is formed with a recess 331 for receiving the fastening seats 310 therein such that the latter are clamped by the clamping block. One side of the clamping block is formed with two screw holes 332 (only one is shown) that extend to the recess 331. Screws 333 extend threadedly through the screw holes 332 and are extendible through the notch 312 of a respective one of the fastening seats 310. After the fastening portion 321 of the fastening lever 320 has been extended fully into the rectangular holes 311 of the fastening seats 310, the clamping unit 330 is installed such that the fastening seats 310 are clamped by the clamping block. The screws 333 are then extended through the notches 312 of the fastening seats 310 so as to abut tightly against the fastening portion 321 of the fastening lever 320, thereby preventing undesired rotation of the fastening lever 320 to ensure stable connection of the adjacent horizontal form units 5. From the foregoing, it can be understood that the fastening apparatus 300 can be easily operated to interconnect adjacent ones of the horizontal form units 5, the cover plates 51 and the form plates of the edge form unit 9, thereby facilitating dismantling of the floor form assembly. Installation of the clamping unit 330 ensures stable connection to prevent untimely disassembly of the floor form assembly due to the presence of external lateral forces.

Figure 10:
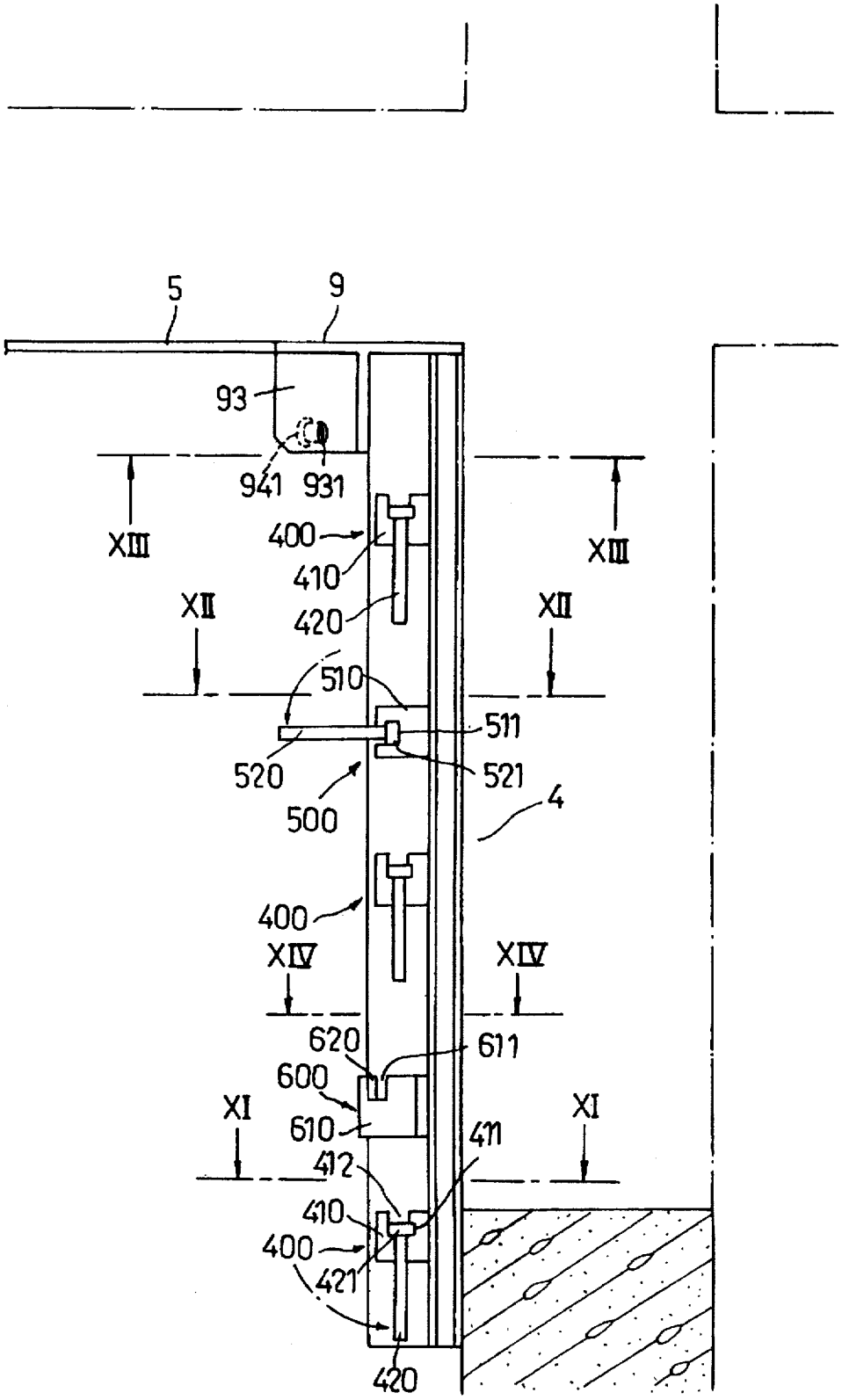
FIG. 10 is a side view illustrates the connection between adjacent form plates of a horizontal form unit of the first preferred embodiment.
Figure 11:
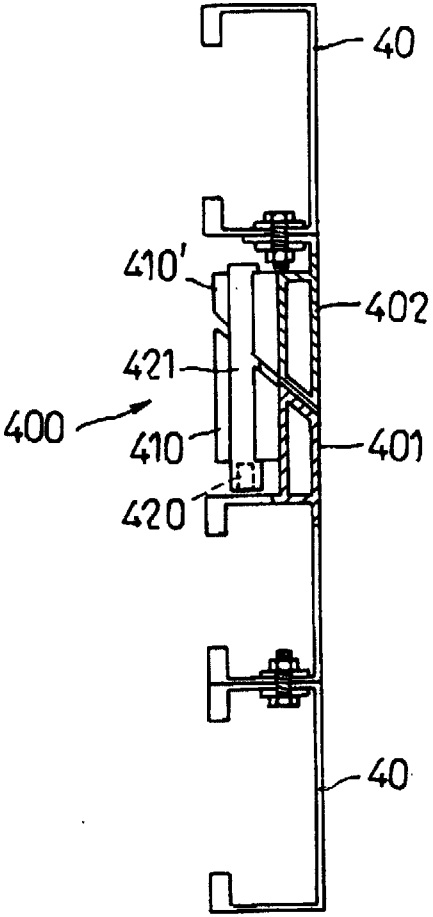
FIG. 11 is a sectional view of the first preferred embodiment, taken along line XI—XI in FIG. 10, which illustrates a fastening apparatus for interconnecting adjacent vertical form units of the first preferred embodiment.

Referring to FIGS. 10 and 11, a plurality of fastening apparatus 400 are employed to interconnect removably adjacent ones of the vertical form units 4. Each fastening apparatus 400 includes two fastening blocks 410, 410' (FIG. 11) disposed respectively on two sides of the mating edges of an adjacent pair of vertical form units 4, and an L-shaped fastening lever 420. Referring to FIG. 11, each of the vertical form units 4 has a connecting plate 401, 402. The connecting plates 401, 402 have inclined mating edges similar to the inclined ends 90 of the form plates of the edge form unit 9 to facilitate installation. The connecting plates 401, 402 have a rear side formed with a respective one of the fastening blocks 410, 410'. The fastening blocks 410, 410' have complementary adjoining sides and are trapezoidal in shape when viewed from above. The fastening blocks 410, 410' are formed with aligned rectangular holes 411 and notches 412 located on one side of the rectangular holes 411 and extending to the rectangular holes 411 to serve as an entry for the latter. Thus, the fastening blocks 410, 410' have cross sections substantially similar to that of the fastening seats 310 described beforehand. In the fastening blocks 410, 410', however, the vertical length of the rectangular hole 411 is shorter than the horizontal length of the same. The fastening lever 420 has a handle portion and a fastening portion 421 that extends transversely from one end of the handle portion. The fastening portion 421 has a generally rectangular cross section with rounded corners and corresponds in size with the rectangular holes 411 of the fastening blocks 410, 410'. The fastening portion 421 is thinner than the length of the notches 412 of the fastening blocks 410, 410'.

In order for the fastening lever 420 to interconnect the fastening blocks 410, 410', the fastening portion 421 of the fastening lever 420 is inserted partially into the rectangular holes 411 via the notches 412 of the fastening blocks 410, 410'. The fastening lever 420 is then turned by a 90° angle such that the fastening portion 421 extends fully into the rectangular holes 411 to connect the fastening blocks 410, 410', thereby firmly connecting the connecting plates 401, 402.

Figure 12:
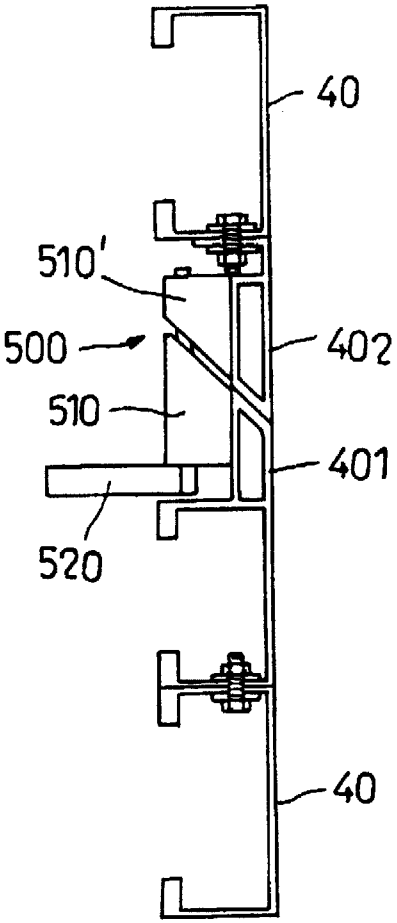
FIG. 12 is a sectional view of the first preferred embodiment, taken along line XII—XII in FIG. 10, which illustrates another fastening apparatus for interconnecting adjacent vertical form units of the first preferred embodiment.
Figure 13:
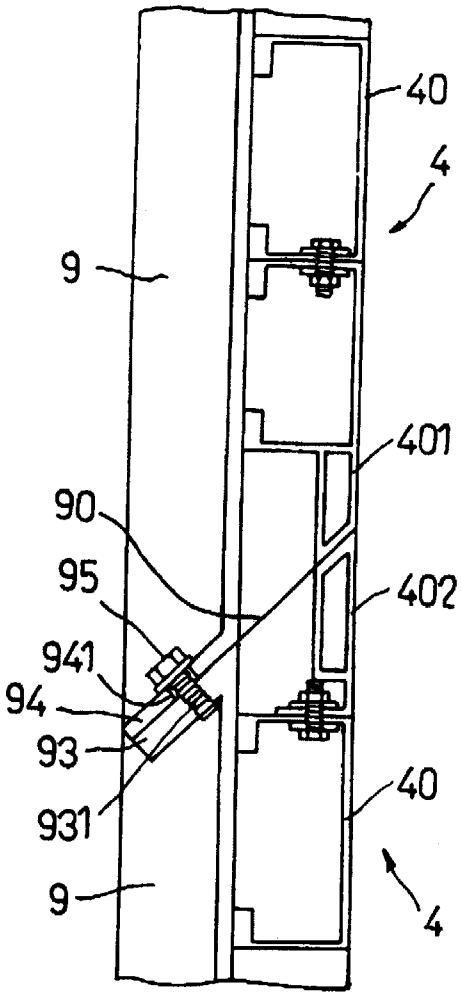
FIG. 13 is a sectional view of the first preferred embodiment, taken along line XIII—XIII in FIG. 10, which illustrates the connection between adjacent form plates of an edge form unit of the first preferred embodiment.

Referring again to FIG. 10, a plurality of fastening apparatus 500, which are similar to the fastening apparatus 400 in construction, may be used to interconnect the upper portions of the connecting plates 401, 402. As shown in FIGS. 10 and 12, each fastening apparatus 500 includes two fastening blocks 510, 510' formed respectively on the connecting plates 401, 402 and having a rectangular hole 511 and a notch 512 that serves as an entry for the rectangular hole 511. Unlike the rectangular holes 411 formed in the fastening blocks 410, 410', the vertical length of the rectangular hole 511 is longer than the horizontal length of the same. A fastening lever 520 has a handle portion and a fastening portion 521 that extends transversely from the handle portion. In order for the fastening lever 520 to interconnect the fastening blocks 510, 510', the fastening portion 521 of the fastening lever 520 is inserted partially into the rectangular holes 511 via the notches 512 of the fastening blocks 510, 510'. The fastening lever 520 is then turned by a 90° angle such that the fastening portion 521 extends fully into the rectangular holes 511 to connect the fastening blocks 510, 510', thereby firmly connecting upper portions of the connecting plates 401, 402. The fastening apparatus 500 ensure that the top ends of the connecting plates 401, 402 remain flush so that the edge form unit 9 can be positioned properly thereon, Referring to FIGS. 10 and 13, the inclined ends 90 of adjacent form plates of the edge form unit 9 have a pair of connecting plates 93, 94 secured thereon. The connecting plate 93 is formed with a screw hole 931, while the connecting plate 94 is formed with a through hole 941 that is aligned with the screw hole 931. A screw 95 extends through the through hole 941 and engages the screw hole 931, thereby interconnecting the adjacent form plates of the edge form unit 9. In addition, a form contracting apparatus 600 is provided on a lower portion of an adjacent pair of the vertical form units 4.

Figure 14:
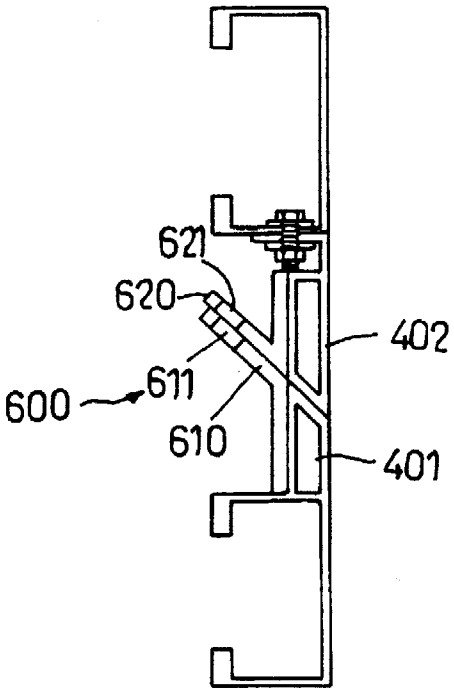
FIG. 14 is a sectional view of the first preferred embodiment, taken along line XIV—XIV in FIG. 10, which illustrates joining plates of a form contracting apparatus of the present invention.

Referring to FIG. 14, the form contracting apparatus 600 includes a pair of joining plates 610, 620 that extend rearwardly and inclinedly from the inclined mating edges of the connecting plates 401, 402. Preferably, the joining plates 610, 620 extend at the same angle as that of the mating edges of the connecting plates 401, 402 and are in sliding contact with each other. The joining plates 610, 620 are formed with rectangular notches 611, 621 that have equal widths. When the flat surfaces of the connecting plates 401, 402 are flush with one another, the rectangular notches 611, 621 are only partially aligned.

Figure 15:
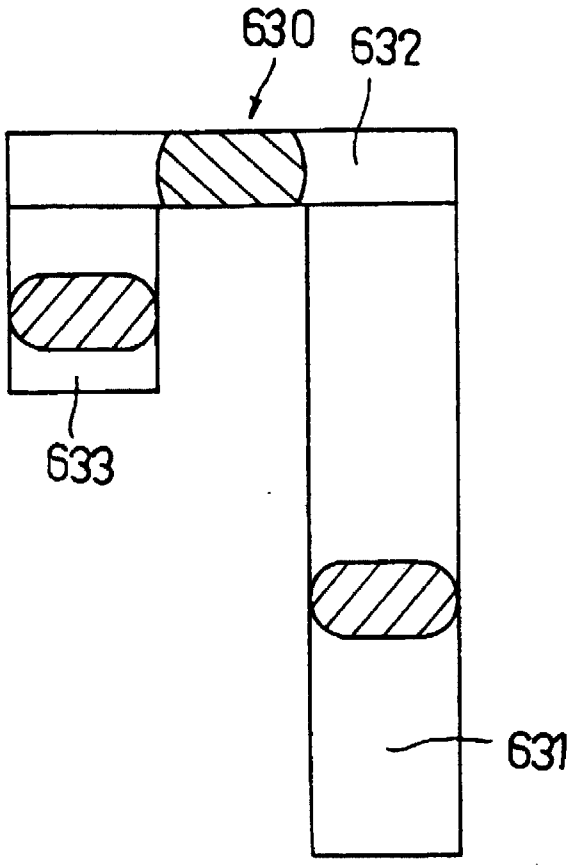
FIG. 15 is a side view of an operating lever of the form contracting apparatus of the present invention.

Referring to FIG. 15, the form contracting apparatus 600 further includes an L-shaped operating lever 630. The operating lever 630 has a handle portion 631 and a fastening portion 632 which extends transversely by a 90° angle from the handle portion 631. The fastening portion 632 has a distal end section 633 which is opposite to the handle portion 631 and which extends in a same direction as the handle portion 631. The fastening portion 632 has a generally rectangular cross section with longer and shorter sides that form a predetermined height difference. The shorter sides of the fastening portion 632 have a length which is sufficient to permit insertion of the fastening portion 632 into the rectangular notches 611, 621 of the joining plates 610, 620 when the latter are not partially aligned. The longer sides of the fastening portion 632 have a length equal to the width of the rectangular notches 611, 621. The distal end section 633 is displaced from the handle portion 631 by a distance equal to the combined thickness of the joining plates 610, 620. Thus, the fastening portion 632 can be extended into the rectangular notches 611, 621, and the operating lever 630 can be used to clamp tightly the joining plates 610, 620 to prevent untimely disengagement of the same.

Figure 16:
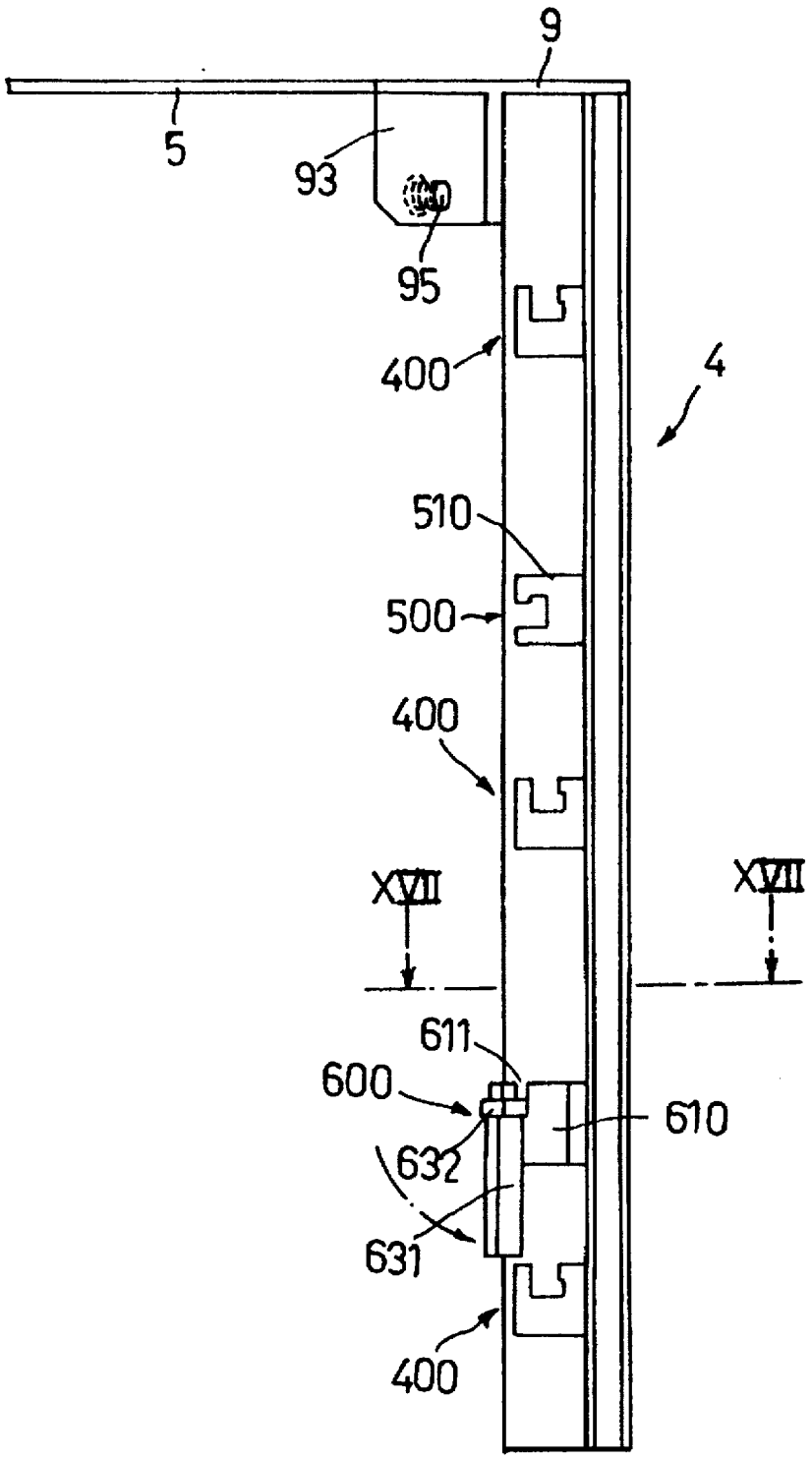
FIG. 16 is a side view which illustrates the operation of the form contracting apparatus.
Figure 17:
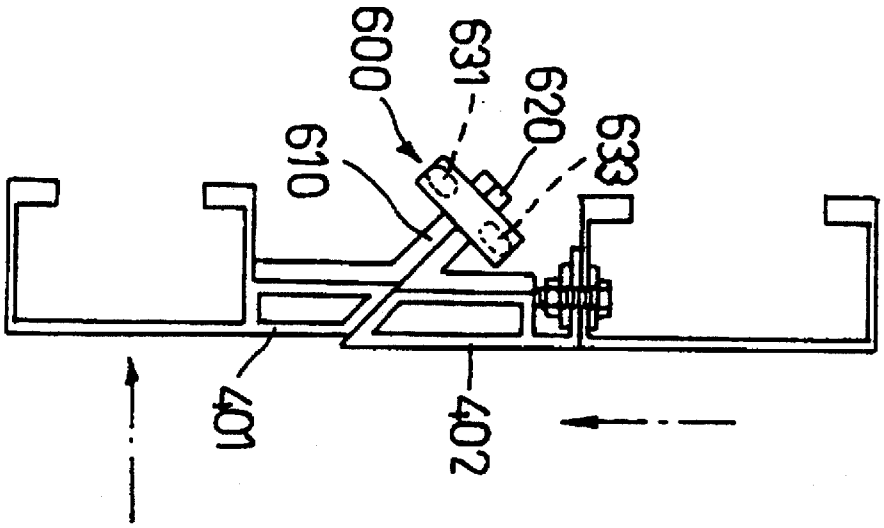
FIG. 17 is a sectional view taken along line XVII—XVII in FIG. 16, illustrating a form contracting operation of the form contracting apparatus.

The form contracting apparatus 600 permits the formation of a predetermined clearance between the flat surfaces of the connecting plates 401, 402. As shown in FIG. 16, before the fastening apparatus 400, 500 are installed to fasten together two adjacent vertical form units 4, the screw 95 on the connecting plates 93, 94 of adjacent form plates of the edge form unit 9 is initially loosened so that the top portions of the connecting plates 401, 402 form a movable connection. The fastening portion 632 of the operating lever 630 is then extended through the rectangular notches 611, 621 such that one of the shorter sides of the fastening portion 632 rests on the bottom of the rectangular notches 611, 621 while the rectangular notches are partially aligned. At this time, the handle portion 631 of the operating lever 630 is disposed horizontally, and the front surfaces of the connecting plates 401, 402 are flush with one another. When the handle portion 631 is turned downwardly by a 90° angle, one of the longer sides of the fastening portion 632 rests on the bottom of the rectangular notches 611, 621 to align fully the latter. At this time, the front surfaces of the connecting plates 401, 402 form a clearance therebetween, as shown in FIG. 17. The connecting plate 401 pivots about the screw 95 such that slight rearward movement of the bottom portion of the same occurs. Because the mating edges of the connecting plates 401, 402 are inclined, slight rearward movement of the connecting plate 401 will result in slight lateral movement of the connecting plate 402. This illustrates how contraction of the entire bottom portion of the enclosing frame that is formed by the vertical form units 4 can be achieved. Although the degree of contraction is small, the contraction of the bottom portion of the enclosing frame facilitates hoisting of the floor form assembly into the room that is confined by the surrounding walls 101, 102, 103, 104 via the open top of the room. After the floor form assembly has been installed on the top portion of the surrounding walls 101, 102, 103, 104, the operating lever 630 is removed, and the fastening apparatus 400, 500 are installed, as shown in FIG. 10. The front surfaces of the connecting plates 401, 402 are flush with each other at this time.

Figure 3:
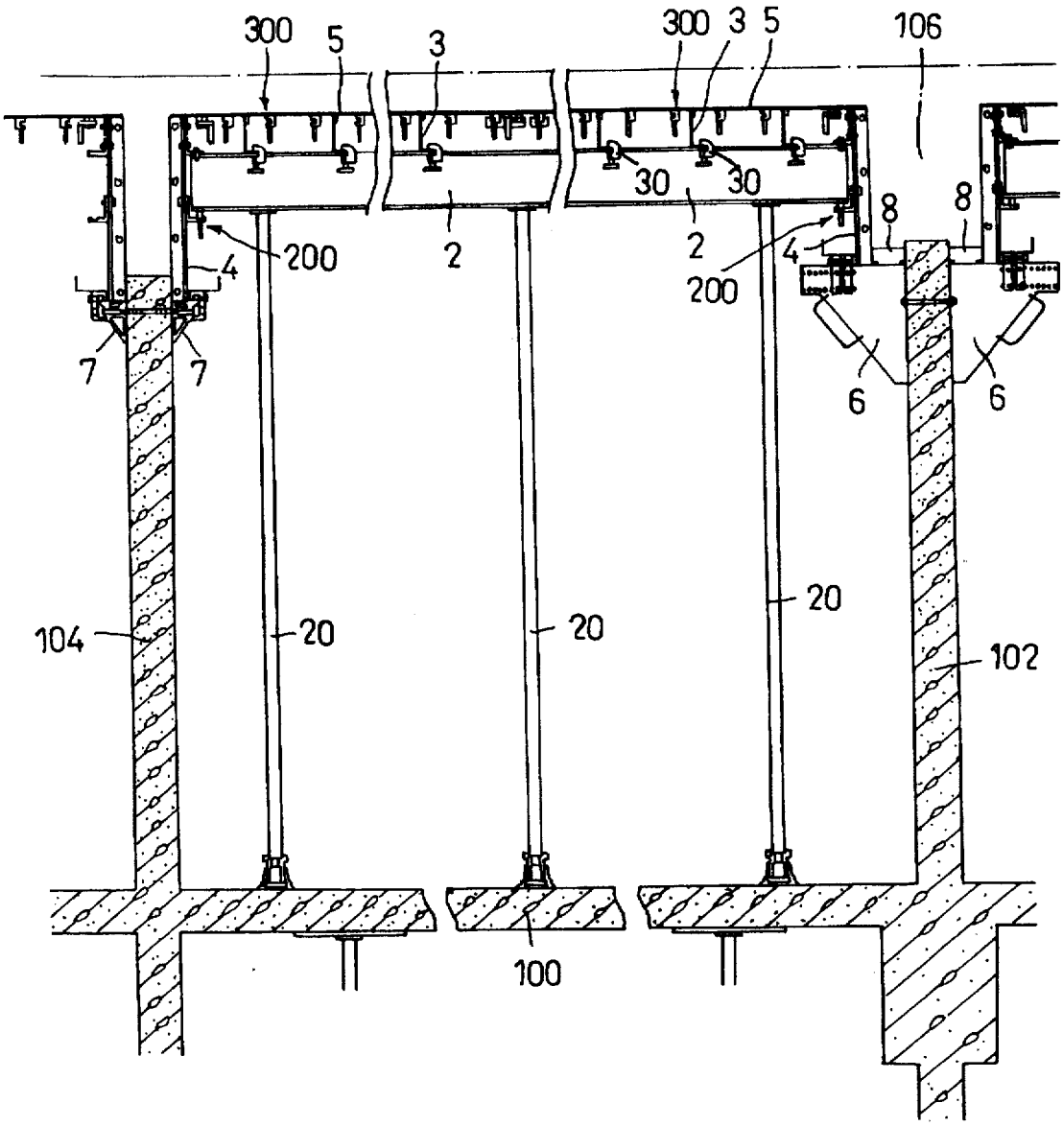
FIG. 3 is a side view of the first preferred embodiment.
Figure 4:
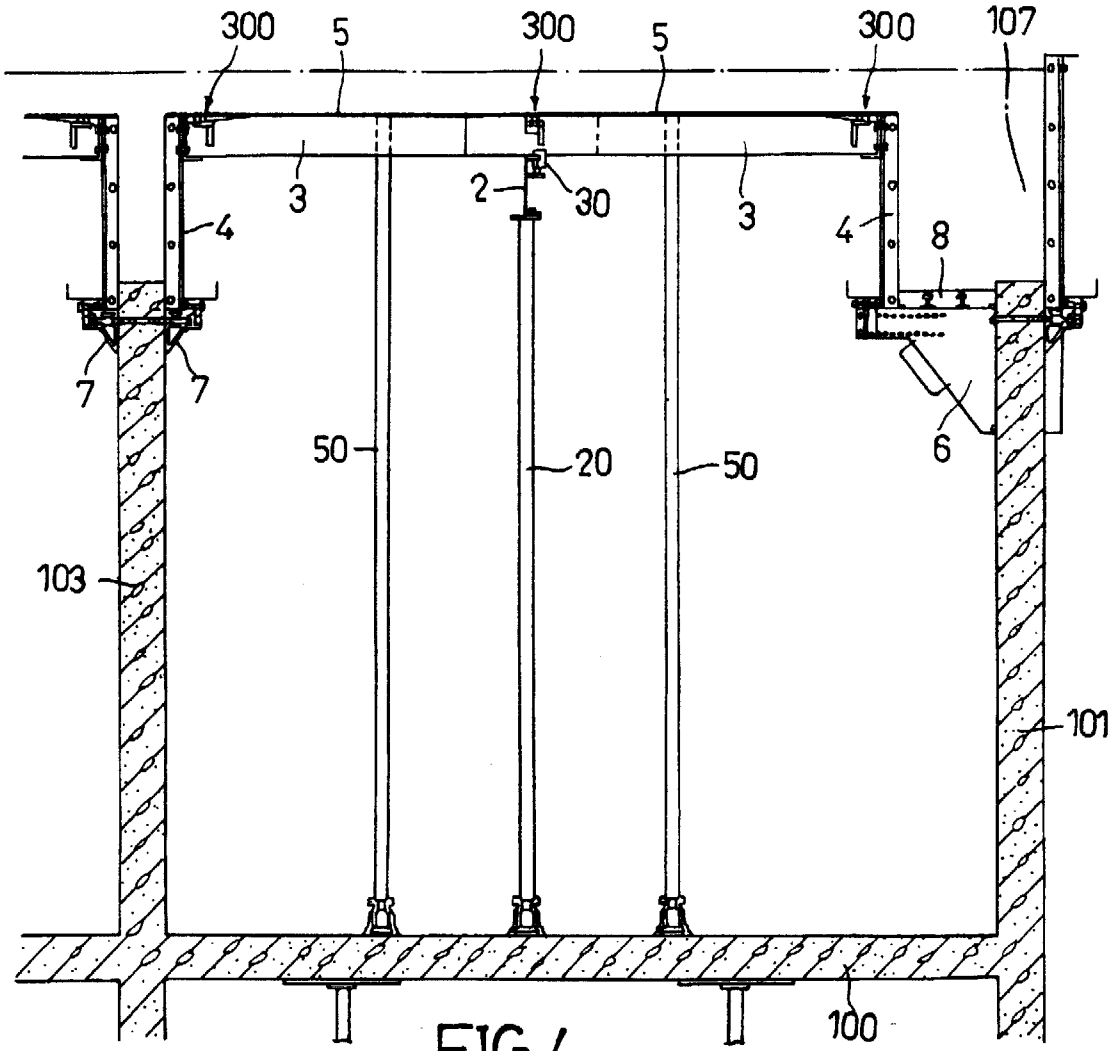
FIG. 4 is another side view of the first preferred embodiment.
Figure 6:
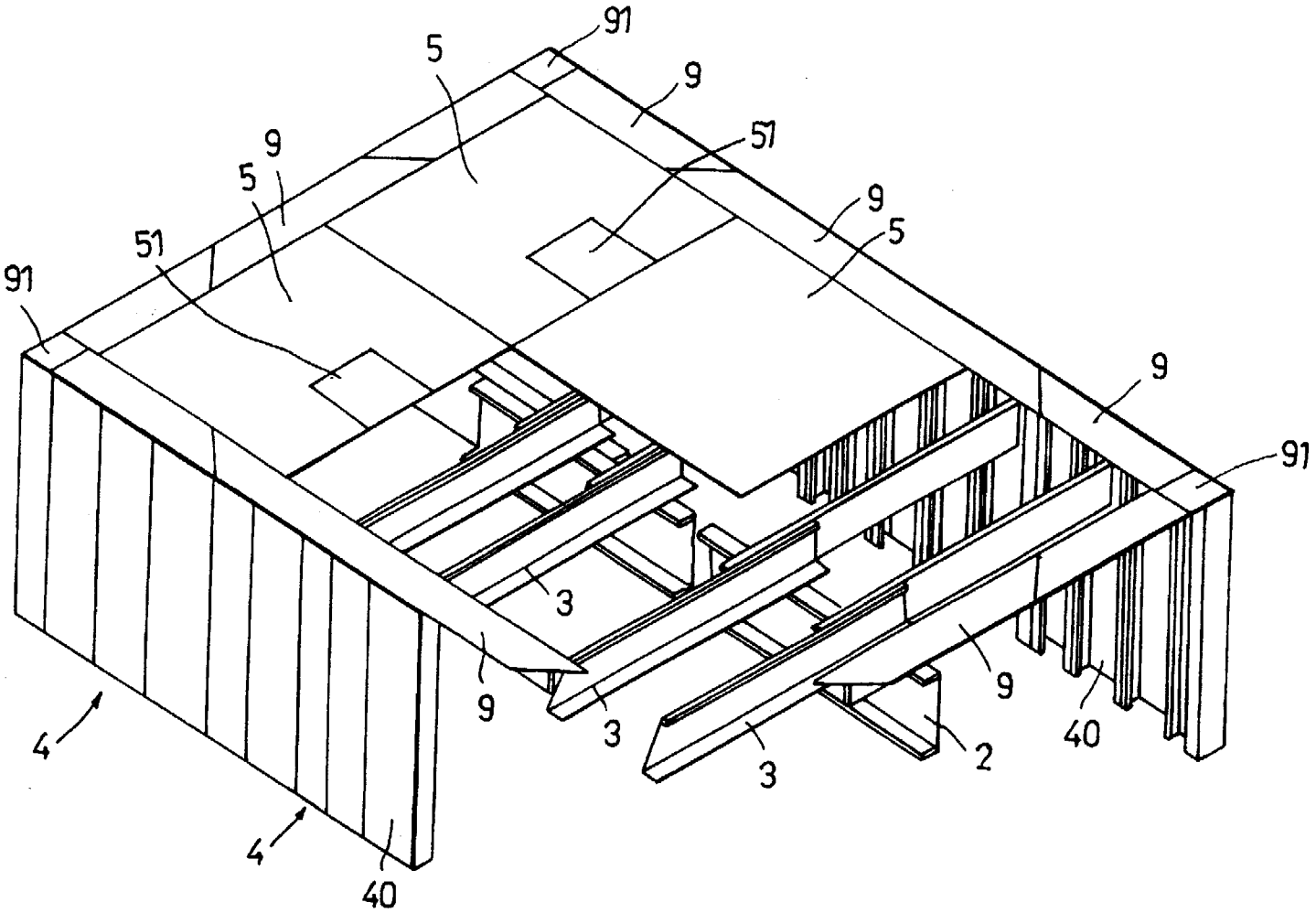
FIG. 6 is a perspective view of the first preferred embodiment.
Figure 18:
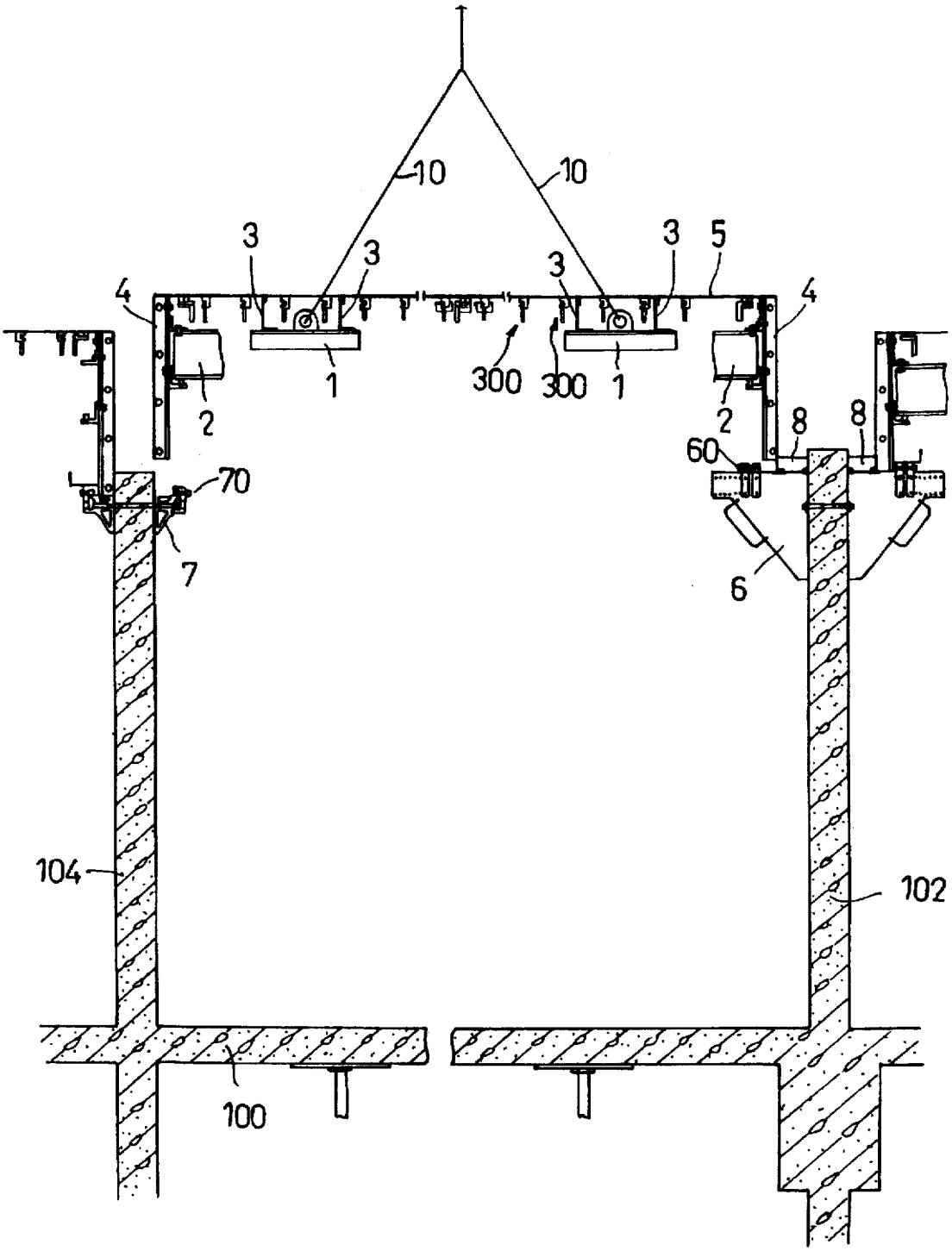
FIG. 18 illustrates how the first preferred embodiment is hoisted into the top portion of a structure that is to be formed with a concrete floor.

When using the floor form assembly in the construction of a concrete floor of an upper storey of a structure, the mounting devices 6, 7 are initially secured on the top portions of the surrounding walls 101, 102, 103, 104 of the structure. The girders 2, the supporting ribs 3, the vertical form units 4, the horizontal form units 5 and the edge form unit 9 are then assembled to form a rectangular cover-like member, as shown in FIG. 6. The cover plates 51 are not yet installed at this time, and the supporting ribs 3 are disposed on carrying units 1, as shown in FIG. 18. After the beam form unit 8 has been provided on the mounting devices 6, the assembly of the girders 2, supporting ribs 3, vertical form units 4, horizontal form units 5 and edge form unit 9 is hoisted into the room so as to be supported on the mounting devices 6, 7 through the use of cables 10 which extend through the rectangular holes in the horizontal form units 5 that have yet to be covered by the cover plates 51 and which are hooked to the carrying units 1. After the vertical form units 4 have been positioned on the mounting devices 6, 7, the screw fasteners 60, 70 on the mounting devices 6, 7 are tightened to retain the floor form assembly on the top portion of the surrounding walls 101, 102, 103, 104. The carrying units 1 are then removed, and the cover plates 51 are positioned below the horizontal form units 5 to cover the rectangular holes in the latter. The fastening apparatus 300, 400, 500 are then installed to connect removably the different components of the floor form assembly, as shown in FIGS. 3 and 4. The props 20 are installed to support the girders 2 for bearing the weight of concrete, and the cover plates 51 are supported on the posts 50. Reinforcing steel bars for the floor that is to be constructed may placed on top of the floor form assembly. Finally, concrete is poured on the floor form assembly to construct the floor 100 of the upper storey and the horizontal structural beams 106, 107.

Figure 19:
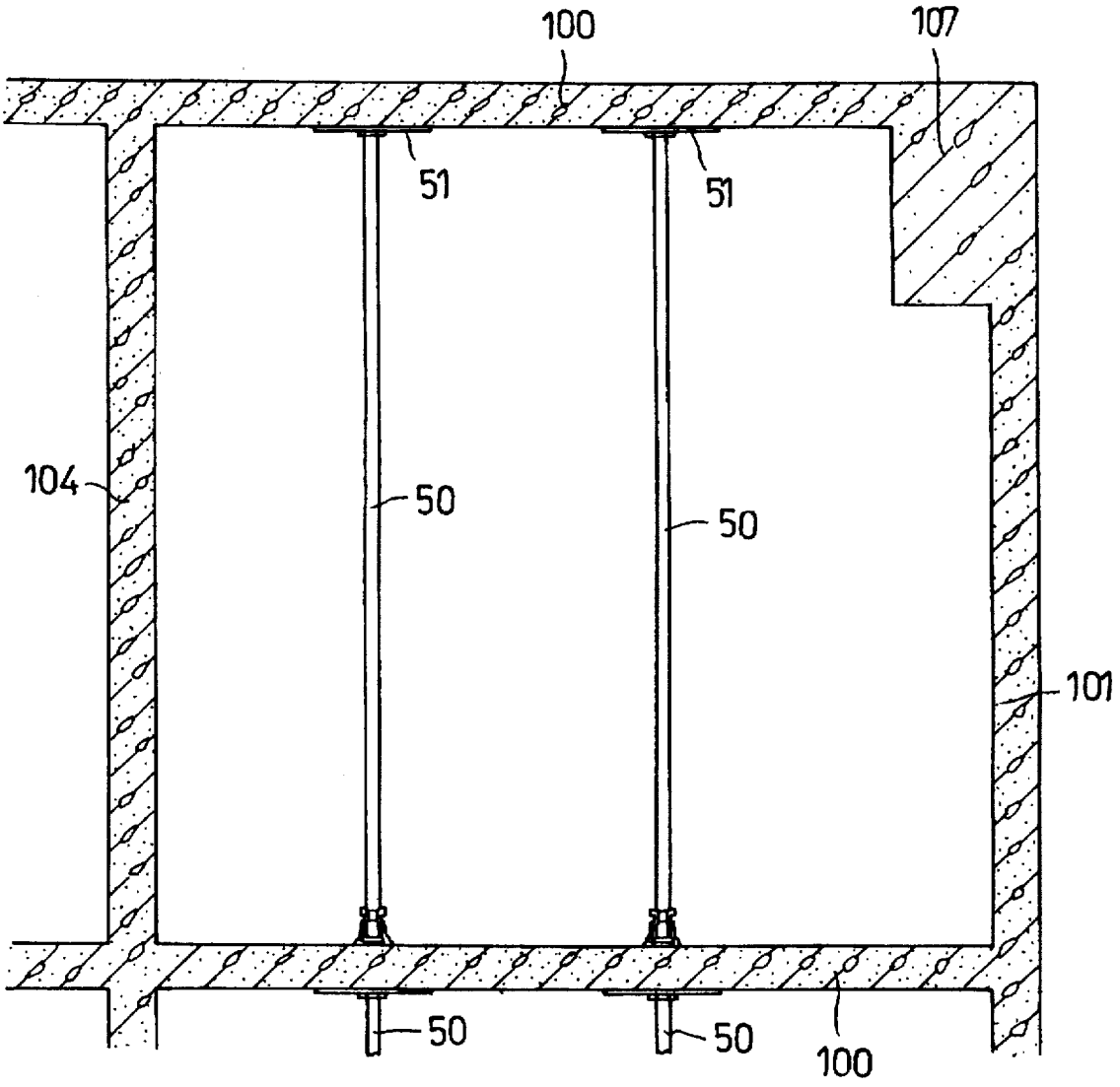
FIG. 19 illustrates how a newly constructed concrete floor is supported after the first preferred embodiment has been dismantled.

After concrete has been poured on the floor form assembly, the concrete is left to dry for a period of time so as to harden the same. Once the concrete has hardened to possess sufficient strength, the props 20 are dismantled, and the girders 2, the supporting ribs 3, the vertical form units 4, the horizontal form units 5, the beam form unit 8, the edge form unit 9, and the mounting devices 6, 7 are removed one at a time. As shown in FIG. 19, the cover plates 51 and the posts 50 remain to support the newly constructed floor 100 for a longer period of time to avoid any adverse effect to the floor 100 due to quick removal of the floor form assembly. Since the girders 2, the supporting ribs 3, the vertical form units 4, the horizontal form units 5, the beam form unit 8, the edge form unit 9, and the mounting devices 6, 7 can be dismantled at an earlier time, they can be moved to a new location for reassembly in preparation for the construction of the floor of an upper storey of the structure. The turnover of use of the different components of the floor form assembly can be increased to result in a shorter construction time and in increased construction efficiency.

After the props 20 have been removed when dismantling the floor form assembly, the C-shaped clamps 30 are then removed to disconnect the girders 2 and the supporting ribs 3. The operating levers 220 of the supporting apparatus 200 are then actuated, such that the handle portions of the operating levers 220 are substantially horizontal, in order to cause slight downward movement of the girders 2. This results in the formation of a vertical clearance between the supporting ribs 3 and the horizontal form units 5 to facilitate removal of the supporting ribs 3. As mentioned beforehand, the distal end portion of each of the supporting ribs 3 is formed with a downwardly inclining top edge 31 to facilitate movement and slight rotation of the supporting ribs 3 during disassembly.

The vertical form units 4, the horizontal form units 5 and the form plates of the edge form unit 9 can be easily disassembled after the levers 320, 420, 520 of the fastening apparatus 300, 400, 500 have been operated. By loosening all screw fasteners that are present, the floor form assembly and the mounting units 6, 7 thereof can be dismantled into a number of smaller pieces. In the preferred embodiment, in order to facilitate transport of the floor form assembly to the outside of the room after the floor 100 has been formed, not only should the connection among the different components be simple and secure, the different components of the floor form assembly should have an appropriate size and weight to permit carrying and moving of the same outdoors via window and door openings that are formed in the surrounding walls 101, 102, 103, 104. Preferably, the different components of the floor form assembly should be made of a material that is lightweight and that has sufficient structural strength, such as aluminum alloy. In this embodiment, the weight of each component should range from 20 to 40 kilos to permit carrying of the same manually. The floor form assembly is modular so that it can be configured to suit the shape of the room. In addition, the floor form assembly can be easily assembled and quickly disassembled, thereby resulting in increased economic benefits when applied in the construction of buildings.

As shown in FIGS. 5 and 6, the form plates of the edge form unit 9 are installed around the horizontal form units 5. Since the form plates of the edge form unit 9 are T-shaped in cross section, the bottom ends thereof can be easily secured to the vertical form units 4 by means of screw fasteners in order to ensure tight contact with the horizontal form units 5.

Figure 20:
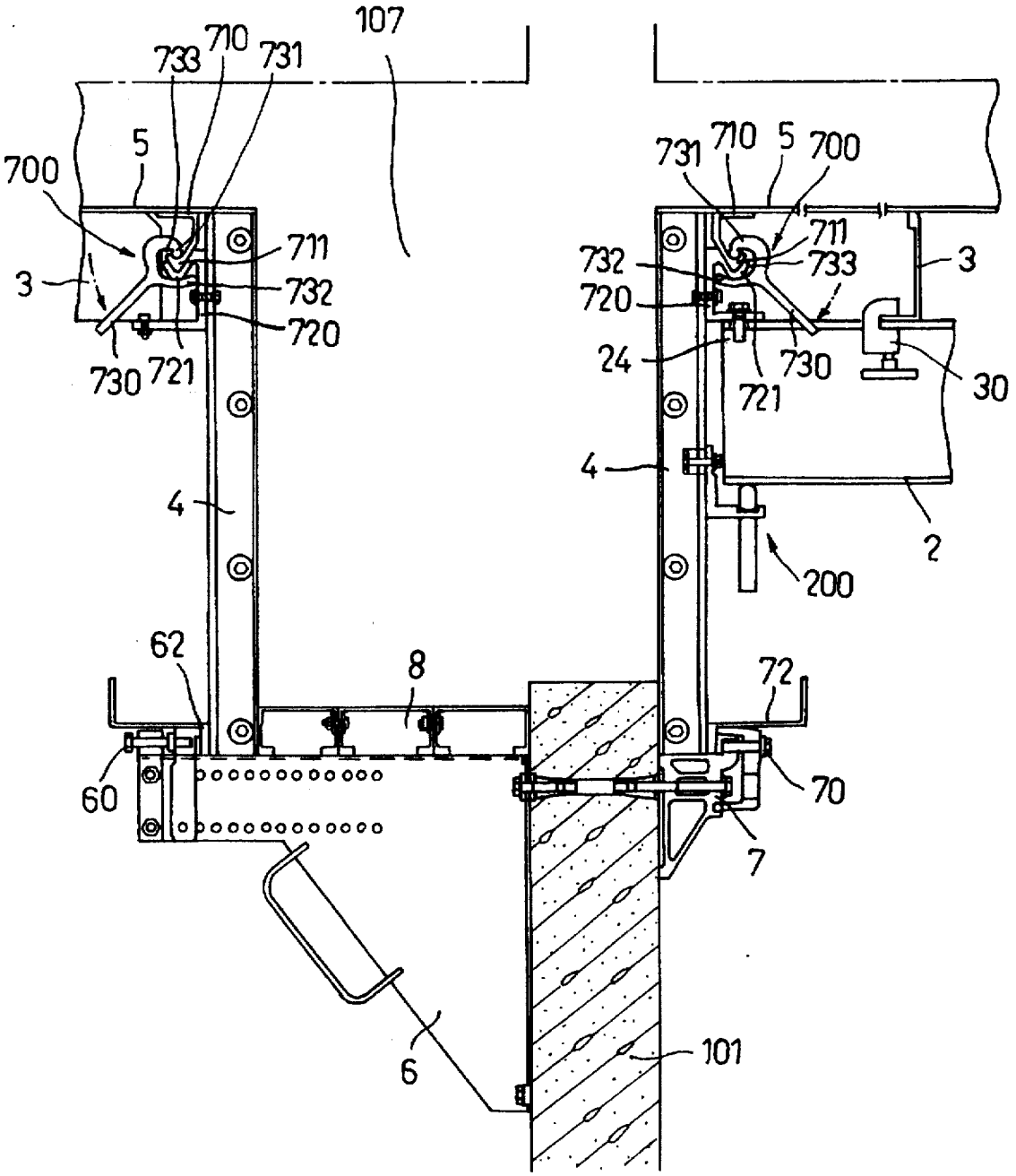
FIG. 20 is an enlarged view illustrating the connection among the vertical and horizontal form units of the second preferred embodiment of a floor form assembly according to the present invention.
Figure 21:
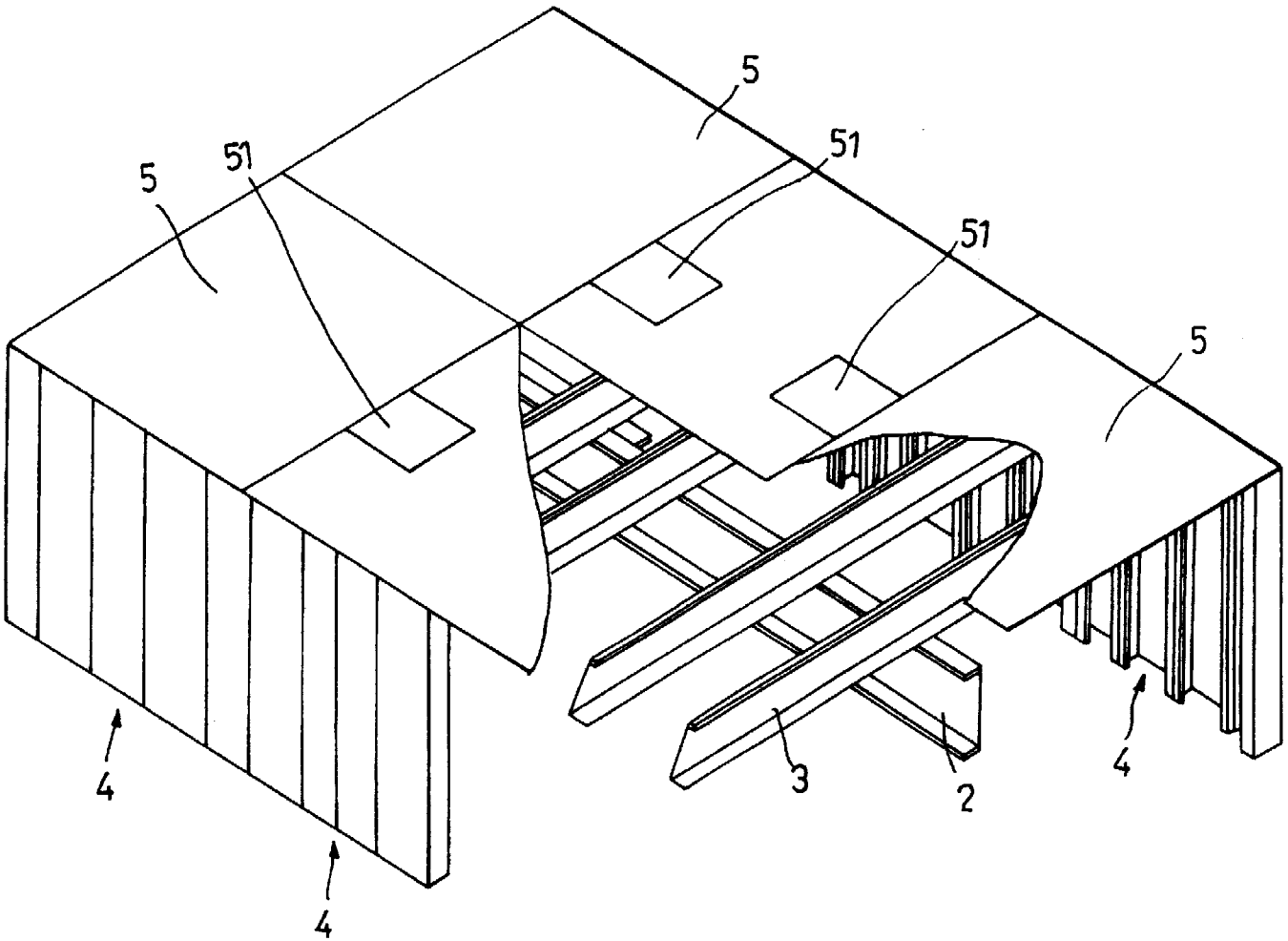
FIG. 21 is a perspective view of the second preferred embodiment.

FIGS. 20 and 21 illustrate the second preferred embodiment of a floor form assembly according to the present invention. As shown, the floor form assembly does not include an edge form unit, and the horizontal form units 5 are secured directly to the vertical form units 4 by means of fastening apparatus 700. Each fastening apparatus 700 includes first and second connecting plates 710, 720 and a clamping lever 730.

The first connecting plate 710 is an elongated plate that is welded to the periphery of one of the horizontal form units 5 at a bottom side of the latter. The first connecting plate 710 is formed with a downwardly extending hook portion 711.

The second connecting plate 720 is an elongated plate that is secured to the rear side of one of the vertical form units 4 at a top portion of the latter. The second connecting plate 720 is formed with a hook portion 721 that engages fittingly and removably the hook portion 711 such that the latter is superimposed thereon.

The clamping lever 730 has a handle portion with a jaw portion formed on a front end. The jaw portion includes a hooking jaw 731 and a curved supporting jaw 732. The jaws 731, 732 confine a space 733 therebetween. The jaw 731 has a distal end which forms a clearance with the jaw 732 that serves as an entry into the space 733 and that has a width which is equal to the combined thickness of the hook portions 711, 721. As shown in FIG. 20, when the clamping lever 730 inclines at an angle of about 45°, the jaws 731, 732 clamp the hook portions 711, 721 therebetween to interconnect the first and second connecting plates 710, 720.

The purpose of the fastening apparatus 700 is to connect the horizontal form units 5 to the vertical form units 4. When connecting one of the horizontal form units 5 to one of the vertical form units 4, the hook portion 711 of the first connecting plate 710 is superimposed on the hook portion 721 of the second connecting plate 720, and the distal ends of the hook portions 711, 721 are inserted into the space 733 confined by the jaws 731, 732 of the clamping lever 730 via the clearance formed between the jaws 731, 732. When the clamping lever 730 is rotated, the jaws 731, 732 clamp the hook portions 711, 721 therebetween to achieve tight connection between the first and second connecting plates 710, 720 to interconnect securely the vertical form unit 4 and the horizontal form unit 5. When disassembling the floor form assembly, the clamping lever 730 is rotated in the opposite direction to permit removal of the same from the first and second connecting plates 710, 720. The horizontal form unit 5 can be removed from the vertical form unit 4 at this time. A perspective view of the floor form assembly of the second preferred embodiment, which does not incorporate an edge form unit, is shown in FIG. 21. Like the previous embodiment, the second preferred embodiment is similarly hoisted into a room when forming the floor of an upper storey of a building structure.

It has thus been shown that the floor form assembly of the present invention employs a plurality of removable girders 2, supporting ribs 3, vertical form units 4 and horizontal form units 5, and is to be used with fastening apparatus 300, 400, 500, a form contracting apparatus 600 or a fastening apparatus 700. The floor form assembly can be assembled so as to meet the specifications of the intended application, and is to be hoisted into a room that is confined by four surrounding walls and that is to be formed with the floor of an upper storey. The floor form assembly can be conveniently and easily assembled or disassembled, and can be moved manually out of the room via door or window openings in the surrounding walls for reuse after a floor has been constructed with the use of the floor form assembly. Thus, the floor form assembly of the present invention can be used to attain a high construction efficiency and provides a lot of economic benefits when in use.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A floor form assembly adapted for use in the construction of a concrete floor of a structure that is enclosed by surrounding walls, the floor form assembly comprising:

a plurality of mounting devices adapted to be mounted on the surrounding walls at a top portion of the structure;

a plurality of elongated girders connected removably and longitudinally to one another so as to be adapted to extend along a lengthwise direction of the top portion of the structure;

a plurality of supporting ribs connected removably to said girders such that said supporting ribs extend transversely from opposite longitudinal sides of said girders and are disposed spacedly on said girders so as to be adapted to extend along a transverse direction of the top portion of the structure;

a plurality of vertical form units, each being connected removably to distal end portion of one of said girders and said supporting ribs, said vertical form units being adapted to form an enclosing frame that is supported removably on said mounting devices and that is adapted to be disposed at the top portion of the structure; and a plurality of horizontal form units arranged on said supporting ribs and connected removably to one another so as to form a supporting surface for concrete;

whereby, after said girders, said supporting ribs, said vertical form units and said horizontal form units have been assembled, assembly of said girders, said supporting ribs, said vertical form units and said horizontal form units is hoisted into the top portion of the structure to serve as a support for the concrete floor to be constructed.

2. The floor form assembly as claimed in claim 1, further comprising an edge form unit which is T-shaped in cross-section and which has a bottom end connected removably to top end of one of said vertical form units and a top end flush with and connected removably to one of said horizontal form units.

3. The floor form assembly as claimed in claim 1, wherein at least one of said horizontal form units has a hole formed therethrough, the floor form assembly further comprising at least one cover plate for covering the hole in a respective one of said horizontal form units.

4. The floor form assembly as claimed in claim 2, wherein at least one of said horizontal form units has a hole formed therethrough, the floor form assembly further comprising at least one cover plate for covering the hole in a respective one of said horizontal form units.

5. The floor form assembly as claimed in claim 1, further comprising a beam form unit supported removably on said mounting devices between said vertical form units and the surrounding walls.

6. The floor form assembly as claimed in claim 2, further comprising a beam form unit supported removably on said mounting devices between said vertical form units and the surrounding walls.

7. The floor form assembly as claimed in claim 1, wherein each of said vertical form units comprises a plurality of elongated form plates which are arranged side-by-side and which are connected removably to one another.

8. The floor form assembly as claimed in claim 2, wherein each of said vertical form units comprises a plurality of elongated form plates which are arranged side-by-side and which are connected removably to one another.

9. The floor form assembly as claimed in claim 5, wherein said beam form unit comprises a plurality of elongated form plates which are arranged longitudinally and successively on said mounting devices.

10. The floor form assembly as claimed in claim 6, wherein said beam form unit comprises a plurality of elongated form plates which are arranged longitudinally and successively on said mounting devices.

11. The floor form assembly as claimed in claim 1, wherein each of said supporting ribs has a distal end portion formed with a downwardly inclining top edge.

12. The floor form assembly as claimed in claim 2, wherein each of said supporting ribs has a distal end portion formed with a downwardly inclining top edge.

13. A supporting apparatus adapted to support a floor form assembly thereon so as to permit slight vertical movement of the floor form assembly, the supporting apparatus comprising:

a stationary mounting seat which has a horizontally extending support portion; and an operating lever which has a handle portion and a carrying portion that extends transversely from one end of said handle portion, said carrying portion having a generally rectangular cross-section with opposite longer sides and opposite shorter sides that adjoin said longer sides, said carrying portion to be disposed between said support portion of said mounting seat and the floor form assembly so as to be adapted to support the floor form assembly on said mounting seat;

whereby, rotation of said operating lever so that a selected one of said longer and shorter sides of said carrying portion abuts the floor form assembly results in slight vertical movement of the floor form assembly.

14. A fastening apparatus adapted to interconnect removably adjacent form units of a floor form assembly, the fastening apparatus comprising:

two fastening seats adapted to be secured respectively on the adjacent form units such that said fastening seats are disposed on two sides of mating edges of the adjacent form units, each of said fastening seats being formed with a rectangular hole and a notch located on a longer side of said rectangular hole and extending to said rectangular hole, said notch being shorter than said rectangular hole; and a fastening lever having a handle portion and a fastening portion that extends transversely from one end of said handle portion, said fastening portion having a generally rectangular cross-section with rounded corners and corresponding in size with said rectangular holes of said fastening seats, said fastening portion being thinner than length of said notches of said fastening seats;

whereby, after said fastening portion of said fastening lever has been extended partially into said rectangular holes of said fastening seats via said notches of said fastening seats, said fastening lever can be rotated such that said fastening portion extends fully into said rectangular holes to interconnect removably the adjacent form units.

15. The fastening apparatus as claimed in claim 14, wherein said fastening portion of said fastening lever has a distal end section which is opposite to said handle portion and which extends in a same direction of said handle portion, said distal end section being displaced from said handle portion by a distance equal to combined thickness of said fastening seats so that said fastening seats can be clamped between said distal end section of said fastening portion and said handle portion to prevent movement of said fastening seats along said fastening portion when said fastening portion extends fully into said rectangular holes of said fastening seats.

16. The fastening apparatus as claimed in claim 14, further comprising a clamping unit which includes a clamping block that is formed with a recess for receiving said fastening seats therein such that said fastening seats are clamped by said clamping block, and at least one screw fastener that extends threadedly through one side of said clamping block and through said notch of one of said fastening seats so as to abut tightly against said fastening portion of said fastening lever to prevent undesired rotation of said fastening lever after the adjacent form units have been interconnected.

17. The fastening apparatus as claimed in claim 15, further comprising a clamping unit which includes a clamping block that is formed with a recess for receiving said fastening seats therein such that said fastening seats are clamped by said clamping block, and at least one screw fastener that extends threadedly through one side of said clamping block and through said notch of one of said fastening seats so as to abut tightly against said fastening portion of said fastening lever to prevent undesired rotation of said fastening lever after the adjacent form units have been interconnected.

18. A form contracting apparatus adapted for use in a floor form assembly having adjacent form units so as to form a clearance between flat surfaces of the adjacent form units, the form contracting apparatus comprising:

a pair of joining plates adapted to be secured respectively on the adjacent form units such that said joining plates extend from mating edges of the adjacent form units, said joining plates being in sliding contact with each other and being formed with a respective rectangular notch, said rectangular notches of said joining plates having equal widths and being partially aligned when the flat surfaces of the adjacent form units are flush with one another; and an operating lever having a handle portion and a fastening portion that extends transversely from one end of said handle portion, said fastening portion having a generally rectangular cross-section with opposite longer sides and opposite shorter sides that adjoin said longer sides, said shorter sides having a length sufficient to permit insertion of said fastening portion into said rectangular notches of said joining plates when said rectangular notches are partially aligned, said longer sides having a length equal to the width of said rectangular notches;

whereby, after said fastening portion of said operating lever has been extended into said rectangular notches of said fastening seats such that one of said shorter sides of said fastening portion rests on bottom of said rectangular notches while said rectangular notches are partially aligned, said fastening lever can be rotated such that one of said longer sides of said fastening portion rests on the bottom of said rectangular notches, thereby aligning fully said rectangular notches and causing the flat surfaces of the adjacent form units to form the clearance therebetween.

19. The form contracting apparatus as claimed in claim 18, wherein said joining plates extend inclinedly from the mating edges of the adjacent form units.

20. The form contracting apparatus as claimed in claim 18, wherein said fastening portion of said operating lever has a distal end section which is opposite to said handle portion and which extends in a same direction of said handle portion, said distal end section being displaced from said handle portion by a distance equal to combined thickness of said joining plates so that said joining plates can be clamped between said distal end section of said fastening portion and said handle portion when said fastening portion extends through said rectangular notches of said joining plates.

21. The form contracting apparatus as claimed in claim 19, wherein said fastening portion of said operating lever has a distal end section which is opposite to said handle portion and which extends in a same direction of said handle portion, said distal end section being displaced from said handle portion by a distance equal to combined thickness of said joining plates so that said joining plates can be clamped between said distal end section of said fastening portion and said handle portion when said fastening portion extends through said rectangular notches of said joining plates.

22. A fastening apparatus adapted to interconnect removably two form units of a floor form assembly, comprising:

a first connecting plate adapted to be secured to one of the form units and formed with a hook portion;

a second connecting plate adapted to be secured to the other one of the form units and formed with a hook portion that engages fittingly and removably said hook portion of said first connecting plate such that said hook portion of said first connecting plate is superimposed thereon; and a clamping lever having a handle portion and a jaw portion formed on one end of said handle portion, said jaw portion including a hooking jaw and a curved supporting jaw, said hooking jaw and said supporting jaw confining a space therebetween, said hooking jaw having a distal end which forms a clearance with said supporting jaw, said clearance serving as an entry into said space and having a width equal to combined thickness of said hook portions of said first and second connecting plates;

whereby, after said hook portion of said first connecting plate is superimposed on said hook portion of said second connecting plate, distal ends of said hook portions can be inserted into said space confined by said jaws of said jaw portion of said clamping lever via said clearance, rotation of said clamping lever causing said hooking jaw and said supporting jaw to clamp said hook portions therebetween to achieve tight connection between said first and second connecting plates and to interconnect securely and removably the form units.

* * * * *